US010794574B2

(12) United States Patent
Hale

(10) Patent No.: US 10,794,574 B2
(45) Date of Patent: Oct. 6, 2020

(54) FORCE-DRIVEN SOCKET FOR LIGHT BULB

(71) Applicant: William Hale, Cumming, GA (US)

(72) Inventor: William Hale, Cumming, GA (US)

(73) Assignee: Wintergreen Corporation, Alpharetta, GA (US)

( * ) Notice: Subject to any disclaimer, the term of this patent is extended or adjusted under 35 U.S.C. 154(b) by 0 days.

(21) Appl. No.: 16/032,132

(22) Filed: Jul. 11, 2018

(65) Prior Publication Data

US 2019/0017686 A1 Jan. 17, 2019

Related U.S. Application Data

(60) Provisional application No. 62/573,212, filed on Oct. 17, 2017, provisional application No. 62/531,973, filed on Jul. 13, 2017.

(51) Int. Cl.

| | |
|---|---|
| ***F21V 21/002*** | (2006.01) |
| ***H01R 33/46*** | (2006.01) |
| ***H01R 33/22*** | (2006.01) |
| ***F21V 19/00*** | (2006.01) |
| ***H01R 33/90*** | (2006.01) |

(52) U.S. Cl.

CPC ..... *F21V 21/002* (2013.01); *F21V 19/006* (2013.01); *H01R 33/22* (2013.01); *H01R 33/46* (2013.01); *H01R 33/90* (2013.01)

(58) Field of Classification Search

CPC ..... F21V 21/002; H01R 33/22; H01R 33/46

See application file for complete search history.

(56) References Cited

U.S. PATENT DOCUMENTS

| | | | | | |
|---|---|---|---|---|---|
| 438,310 | A | * | 10/1890 | Edison | H01R 31/06 439/176 |
| 1,104,577 | A | * | 7/1914 | Thomas | H01R 33/22 439/257 |
| 1,162,354 | A | * | 11/1915 | Hart | H01R 33/22 439/661 |
| 1,187,301 | A | * | 6/1916 | Goodridge | H01R 33/22 439/665 |
| 1,216,884 | A | * | 2/1917 | Thomas | H01R 33/22 439/665 |
| 1,220,993 | A | * | 3/1917 | Sachs | H01R 33/22 439/665 |
| 1,237,718 | A | * | 8/1917 | Speice | H01R 13/187 439/843 |
| 1,327,496 | A | * | 1/1920 | Snider | H01R 33/9555 439/257 |
| 1,341,339 | A | * | 5/1920 | Pattee | H01R 33/22 439/661 |
| 1,640,189 | A | * | 8/1927 | Hamiel | H01R 33/22 439/257 |
| 1,663,264 | A | * | 3/1928 | Thompson | H01R 33/971 439/735 |

(Continued)

*Primary Examiner* — Ross N Gushi

(74) *Attorney, Agent, or Firm* — Rachel H. Huffstetler; FisherBroyles, LLP

(57) ABSTRACT

A socket for allowing a threaded light bulb or a bayonet light bulb to be quickly and effectively inserted into and removed from the socket by axial force, avoiding the need for it to threaded by rotational forces within the socket to achieve connectivity. The socket includes a bulb interface including a plurality of flanges for cooperating with a bulb having a threaded base and/or a bayonet base.

23 Claims, 7 Drawing Sheets

(56) References Cited

U.S. PATENT DOCUMENTS 1,700,495 A * 1/1929 Hayward ..... H01R 13/20 439/256
1,702,135 A * 2/1929 Sawers ..... H01J 5/50 439/668
1,721,365 A * 7/1929 Zwetsch ..... H01R 33/22 439/253
1,728,485 A * 9/1929 Freeman ..... H01R 33/22 439/802
1,907,422 A * 5/1933 Long ..... H01R 33/06 439/257
1,928,657 A * 10/1933 Wolfe ..... H01R 33/9555 439/257
2,071,769 A * 2/1937 Schlicker ..... H01R 33/22 439/257
2,154,812 A * 4/1939 Adalbert ..... B65D 41/0471 220/288
2,191,336 A * 2/1940 Carroll ..... H01R 33/22 439/257
2,253,582 A * 8/1941 Richardson ..... H01R 33/94 439/256
2,549,577 A * 4/1951 Coyle ..... H01R 24/20 439/843
2,640,969 A * 6/1953 Coyle ..... H01R 33/22 439/661
2,648,049 A * 8/1953 Brayman ..... H01R 33/9555 439/257
2,694,798 A * 11/1954 Cole ..... H01R 33/22 439/546
2,869,097 A * 1/1959 Stuart ..... H01R 33/22 439/256
2,965,875 A * 12/1960 Danesi ..... H01R 33/22 439/419
3,005,177 A * 10/1961 Wieckmann ..... H01R 33/22 439/419
3,101,984 A * 8/1963 Wieckmann ..... F16L 37/04 439/253
3,165,370 A * 1/1965 Laub, Sr. ..... H01R 33/22 439/257
3,251,023 A * 5/1966 Schick ..... F21V 21/002 439/414
3,368,184 A * 2/1968 Braun ..... H01R 33/22 439/340
3,422,393 A * 1/1969 Plagge ..... H01R 33/06 439/615
3,500,294 A * 3/1970 Shroyer ..... H01R 33/22 439/647
3,504,329 A * 3/1970 Peterson ..... H01R 33/22 439/257
3,676,835 A * 7/1972 Holly ..... H01K 1/46 439/256
3,895,195 A * 7/1975 Morrison ..... H01R 33/962 200/51.09
4,441,782 A * 4/1984 Kneer ..... H01R 33/22 439/340
4,456,322 A * 6/1984 Ferroni ..... H01R 33/22 200/51.09
4,768,966 A * 9/1988 Doherty ..... H01R 13/44 439/137
4,778,409 A * 10/1988 Maddock ..... H01R 33/22 439/602
4,886,994 A * 12/1989 Ragge, Jr. ..... F21V 19/006 313/318.1
4,915,667 A * 4/1990 Tobias-Pader ..... H01H 85/2005 439/257
5,154,628 A * 10/1992 Skegin ..... H01R 33/46 439/336
5,171,292 A * 12/1992 Ortiz ..... H01R 33/20 439/253
5,176,532 A * 1/1993 Herzog ..... H01R 33/22 313/318.04
5,241,746 A * 9/1993 Herzog ..... H01R 33/22 29/747
5,380,214 A * 1/1995 Ortega, Jr. ..... H01R 33/22 439/253
5,382,181 A * 1/1995 Ortiz ..... H01R 33/20 439/628
5,421,742 A * 6/1995 Huang ..... H01R 4/2404 439/419
5,439,389 A * 8/1995 Cheng ..... F21V 19/006 439/419
5,480,317 A * 1/1996 Herzog ..... H01R 33/22 439/340
5,511,989 A * 4/1996 Cheng ..... F21V 21/002 439/419
5,556,298 A * 9/1996 Huang ..... H01R 4/2406 439/419
5,586,904 A * 12/1996 Huang ..... H01R 33/22 439/419
5,593,324 A * 1/1997 Ito ..... H01R 33/46 439/672
5,595,513 A * 1/1997 Kondo ..... H01R 33/46 439/667
5,632,644 A * 5/1997 Lin ..... H01R 33/22 439/419
5,634,812 A * 6/1997 Chen ..... F21V 21/002 439/419
5,641,303 A * 6/1997 Chiu ..... H01R 33/22 439/419
5,660,561 A * 8/1997 Tseng ..... F21V 19/006 439/419
5,690,506 A * 11/1997 Lin ..... H01R 4/2406 439/419
5,702,267 A * 12/1997 Chen ..... F21V 21/002 439/340
5,749,743 A * 5/1998 Harada ..... H01R 33/46 439/336
5,769,655 A * 6/1998 Tsai ..... H01R 33/22 439/419
5,791,927 A * 8/1998 Iannone ..... H01R 33/9651 439/271
5,807,134 A * 9/1998 Hara ..... H01R 33/22 439/419
5,820,415 A * 10/1998 Chen ..... B29C 45/2622 439/665
5,823,829 A * 10/1998 Suzuki ..... H01R 33/05 439/668
5,848,909 A * 12/1998 Tsai ..... H01R 4/2406 439/206
5,860,830 A 1/1999 Wu
5,897,391 A * 4/1999 Takahashi ..... H01R 33/46 439/336
5,913,696 A * 6/1999 Chen ..... H01R 33/9651 439/419
6,050,846 A * 4/2000 Wang ..... H01R 4/2406 439/419
6,267,612 B1 * 7/2001 Arcykiewicz ..... H01R 13/6275 439/253
6,305,828 B1 * 10/2001 Huang ..... F21V 19/0005 362/249.01
6,406,333 B2 * 6/2002 Harris ..... H01R 33/22 313/318.09
6,547,582 B2 * 4/2003 Matsuba ..... H01R 13/035 439/226
6,652,305 B1 * 11/2003 DiFusco ..... H01R 31/06 439/255
6,910,918 B1 * 6/2005 Driver ..... F21V 21/002 439/542
7,387,407 B2 * 6/2008 Tseng ..... F21V 19/0065 362/249.01
7,413,456 B1 * 8/2008 DiFusco ..... H01R 33/22 439/253
7,513,802 B2 * 4/2009 Tufano, Sr. ..... H01J 5/48 362/458
7,585,187 B2 * 9/2009 Daily ..... F21V 19/0025 362/640
7,618,288 B1 * 11/2009 DiFusco ..... H01R 33/22 439/253

(56) References Cited

U.S. PATENT DOCUMENTS

| | | | | |
|---|---|---|---|---|
| 7,850,472 | B2 * | 12/2010 | Friedrich | H01R 13/506 439/256 |
| 7,905,738 | B2 * | 3/2011 | Donetsky | H01R 4/48 439/254 |
| 8,502,468 | B2 * | 8/2013 | Li | F21V 29/74 315/294 |
| 8,602,802 | B2 * | 12/2013 | Sanchez | H01R 33/94 439/257 |
| 8,668,504 | B2 * | 3/2014 | Cofini | H01R 33/0836 439/101 |
| 9,214,776 | B2 * | 12/2015 | Cofini | H01R 33/0836 |
| 9,478,929 | B2 * | 10/2016 | Smith | H01R 33/22 |
| 9,608,394 | B2 * | 3/2017 | Fruhauff | H01R 33/94 |
| 9,627,830 | B1 * | 4/2017 | Wronski | F21V 19/00 |
| 9,768,571 | B1 * | 9/2017 | Peng | H01R 33/22 |
| 9,793,668 | B1 * | 10/2017 | Peng | H01R 33/22 |
| 9,876,326 | B1 * | 1/2018 | Page | H01R 33/22 |
| 9,897,301 | B1 * | 2/2018 | Peng | F21V 23/06 |

* cited by examiner

FORCE-DRIVEN SOCKET FOR LIGHT BULB

CROSS REFERENCE TO RELATED APPLICATIONS

This application claims the benefit of Provisional Patent Application Nos. 62/573,212, filed Oct. 17, 2017, and 62/531,973, filed Jul. 13, 2017, the disclosures of which are hereby incorporated by reference.

FIELD OF THE INVENTION

The present invention is directed to a socket for allowing a threaded light bulb or a bayonet light bulb to be quickly and effectively inserted into the socket by axial force, avoiding the need for it to be threaded by rotational forces within the socket to achieve connectivity.

BACKGROUND OF THE INVENTION

Installation and removal of a conventional threaded light bulb into a conventional threaded socket, although well accepted for achieving electrical connectivity, is time consuming. The time involved and energy expended becomes excessive when considering installations involving numerous light bulbs, such as string lights and commercial lighting installations. A socket is intended to secure a light bulb into the socket of the lighting fixture (light strand or other fixture) and to conduct electric current through a positive terminal and a ground terminal of the bulb to achieve illumination. As such, it is imperative that the design of the socket facilitate this electrical connection.

In addition to conventional threaded bulbs, bayonet style bulbs also must be quickly and efficiently installed into sockets. A standard fitting for a bayonet bulb requires a male slot for receiving a female component of the bulb and, often, a spring mounted within the socket to secure the connection between the mating components. As such, a bayonet bulb may be inserted into the socket with axial force and twisted to engage the mating members. The spring then urges against the mating members to remain engaged.

SUMMARY OF THE INVENTION

It is, therefore, advantageous for a socket to receive a threaded bulb without requiring the labor-intensive step of threading the individual bulb into the socket. It is also advantageous to enable quick withdrawal of the bulb such as for replacement of the bulb or disassembly of the installation. It is beneficial to also provide a socket which is configured to operatively receive either a threaded light bulb or a bayonet light bulb, interchangeably.

The present invention overcomes shortcomings of the prior art by providing a novel socket configuration permitting axial forces, such as "pushing", to be applied to the bulb within the socket to secure the bulb for use and to achieve the necessary electrical connectivity. This and other objectives are met by the present invention.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention.

As used herein, the terms "proximal" and "distal" (excluding horizontal cross-sections) are used to refer to the axial ends of the socket and various components. The term "proximal end" refers to the end closely adjacent the socket opening for receipt of the bulb and the term "distal end" refers to the end of the socket for connecting to a wire. Also, as used herein, the "axial direction" refers to the longitudinal axis of the socket, along the center thereof. The term "transverse" direction refers to a direction which intersects the longitudinal axis, at any angle.

Figure 1:
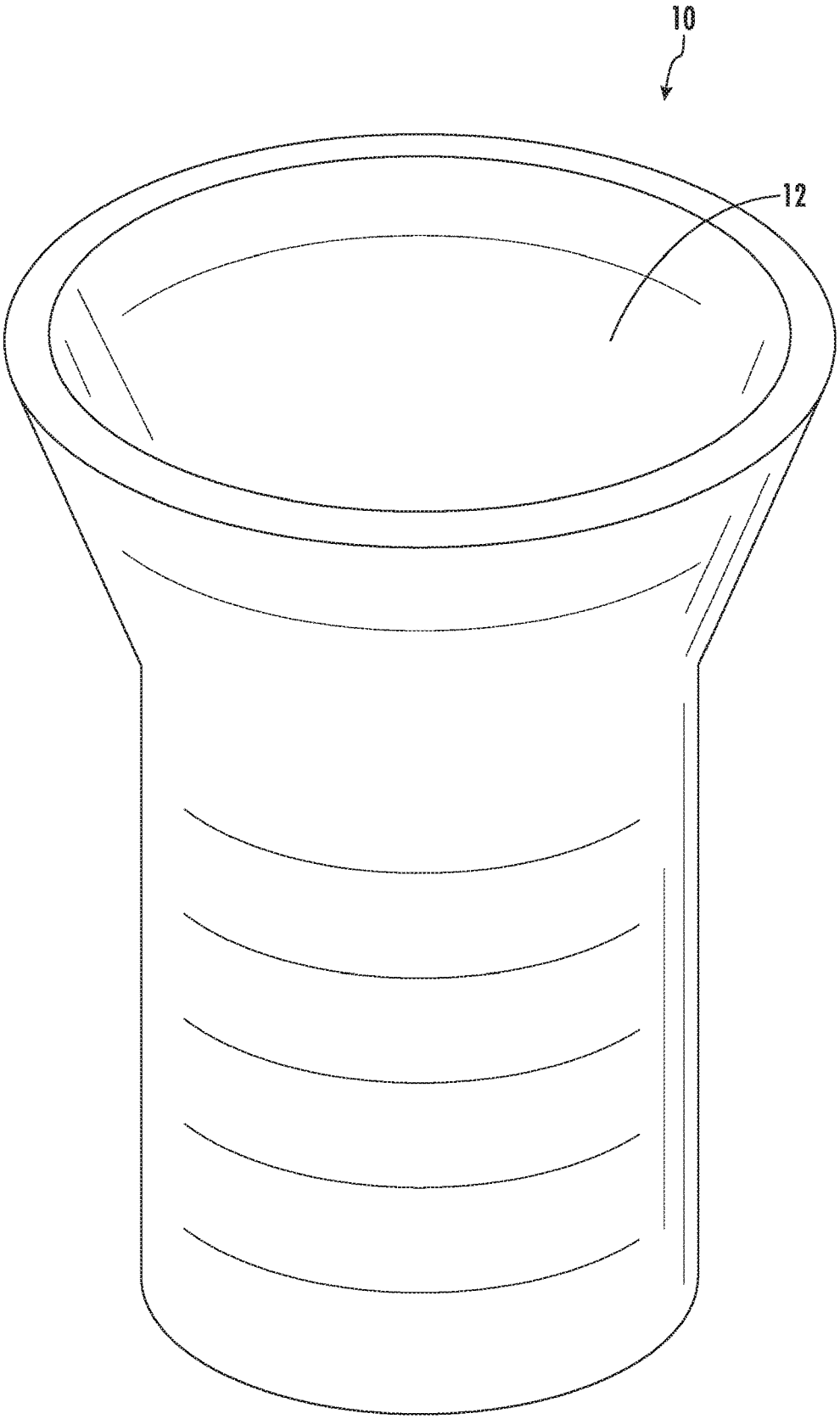
FIG. 1 is a perspective view of the force-driven socket according to an aspect of the present invention.
Figure 2:
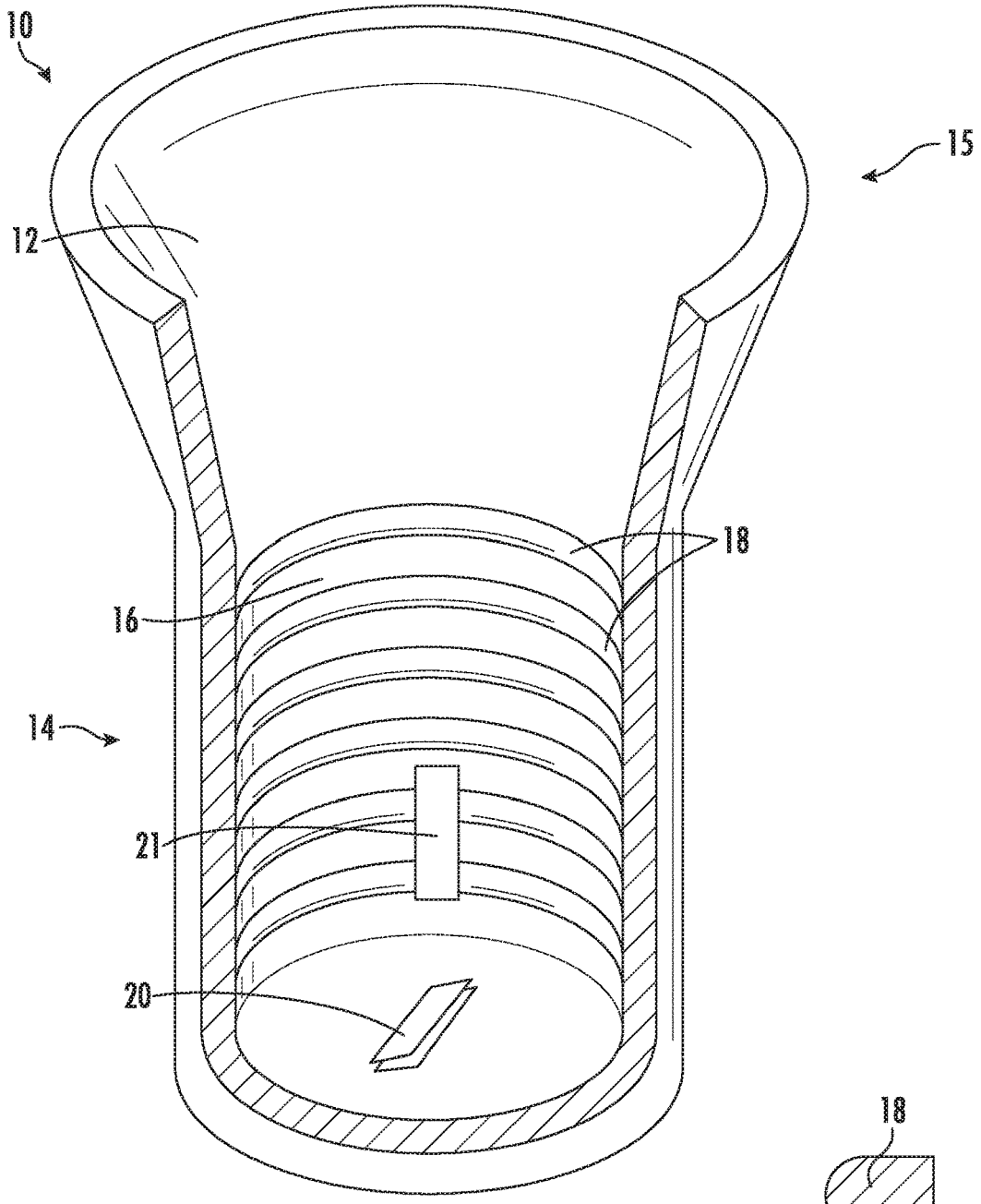
FIG. 2 is a front, cross-sectional view thereof.
Figure 3:
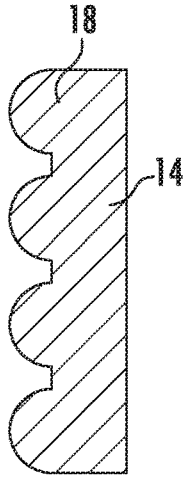
FIG. 3 is an enlarged profile view of the socket thread configuration.

As shown in FIGS. 1-3, the socket 10 is generally cylindrical with a hollow, bulb receiving cavity 12 defined therein. The socket 10 includes a distal portion which is a generally cylindrical portion 14 and a proximal open end configured for receipt of a bulb which, as shown, is a generally conical proximal portion 15. The distal portion 14 defines the bulb interface 16.

The bulb interface 16 includes at least one, and preferably a plurality of, flanges 18 for interfacing with the threads of a bulb. As shown in FIG. 2, six flanges are provided, but it is within the scope of the present invention to provide any number of flanges and even a single flange. Moreover, the predefined spaces between adjacent flanges 18 may vary in longitudinal distance.

As shown in FIG. 3, the flanges 10 have a configuration, in the transverse direction, which is generally curved, such as a semicircle. The flanges are formed of a material having a predetermined hardness to provide sufficient flexibility depending upon the tolerances provided. The predetermined flexibility of the flanges provides for a threaded bulb to be inserted into the cavity 12 of the socket 10 with the application of appropriate distal axial force to urge the flanges axially outward and/or distally for insertion of the bulb. The flanges 18 have a predetermined hardness to nonetheless secure the threads of the bulb to prevent unintentional removal of the bulb. The configuration requires sufficient axial forces in the proximal direction to remove the bulb. The flange configuration permits removal of the bulb by rotational forces or axial forces in the proximal direction.

The socket 10 also includes bottom contact 20 which provides the sockets hot electrical contact point and a side contact 21 which provides the neutral conductor. These are provided to complete the electrical transfer to illuminate the bulb.

Figure 4:
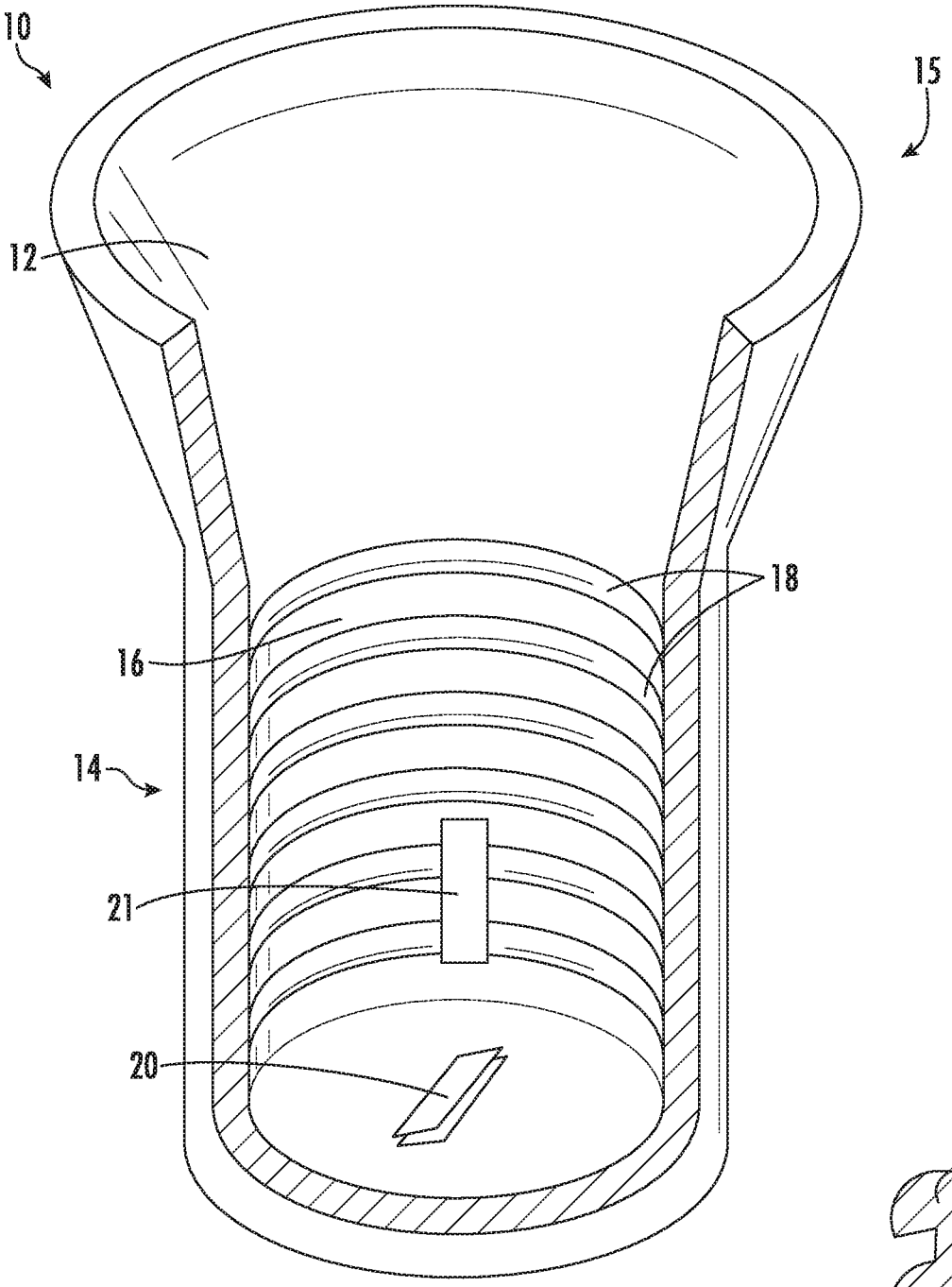
FIG. 4 is a front, cross-sectional of the force-driven socket according to another aspect of the present invention.
Figure 5:
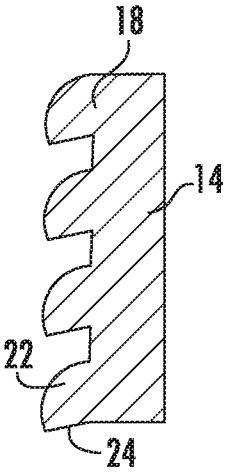
FIG. 5 is an enlarged profile view of the socket thread configuration.
Figure 6:
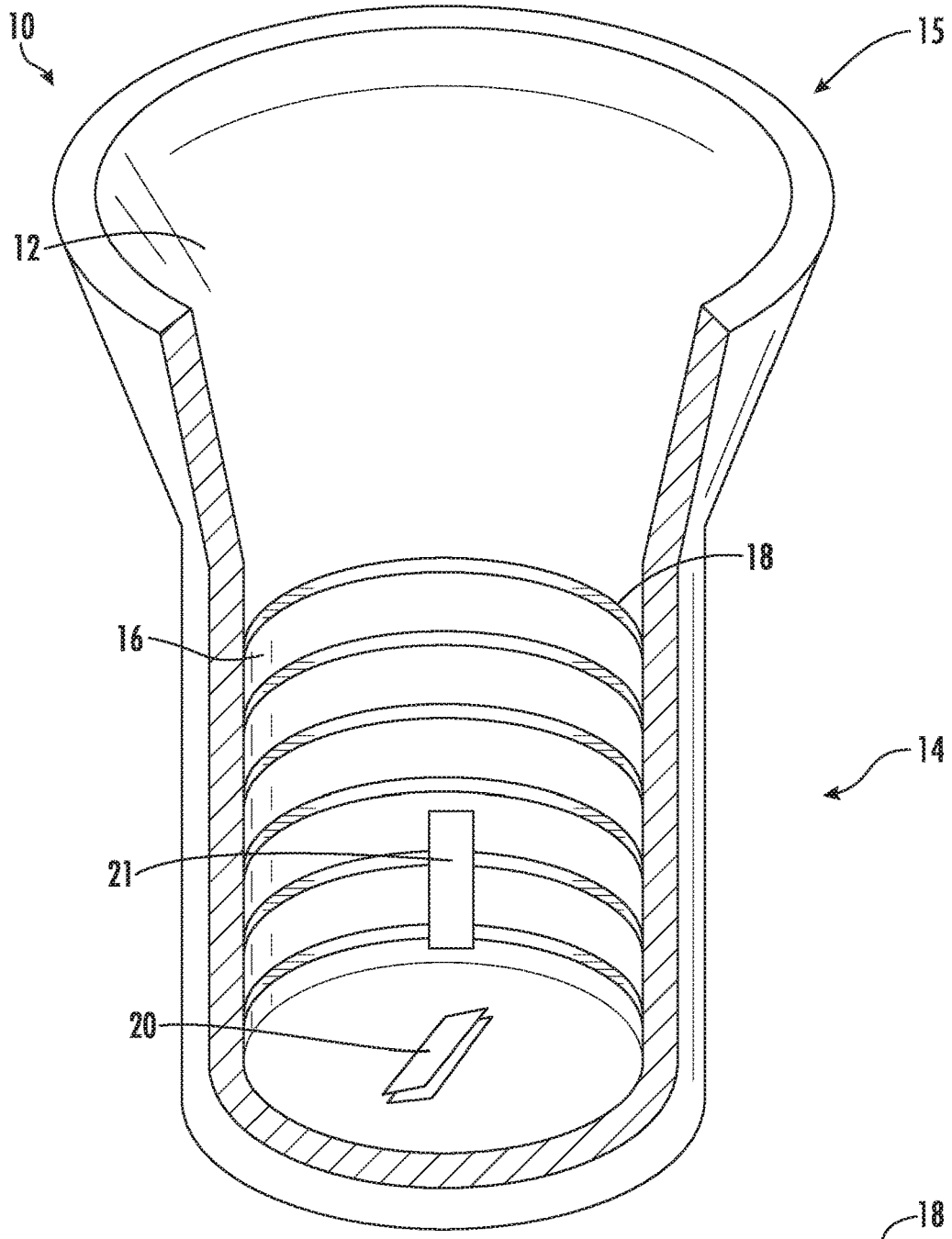
FIG. 6 is a front, cross-sectional view of the force-driven socket according to another aspect of the present invention.

Another aspect of the present invention is shown in FIGS. 4-5. According to this aspect, the bulb interface 16 includes flanges 18 having a unique axial profile. As shown in FIG. 6, the flanges 18 are substantially curvilinear defined by a curved upper surface 22 and a substantially linear bottom surface 24. The flanges 18 according to this aspect of the present invention therefore permits insertion of a threaded bulb with distal axial forces. Removal of the bulb requires application of radial forces to unscrew the bulb from removal of the bulb interface 16. Axial forces, in the proximal direction, alone will not disengage the bulb from the bulb interface 16.

Figure 7:
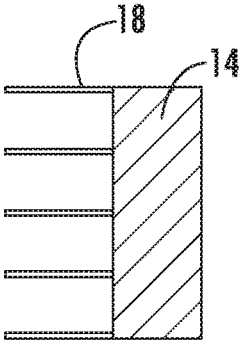
FIG. 7 is an enlarged profile view of the socket thread configuration.

FIGS. 6-7 illustrate another aspect of the present invention. The bulb interface 16 includes at least one flange 18 and, as shown, a plurality of flanges 18. The flanges 18 are defined by generally linear fingers 18 having a flat upper and bottom surface. The flanges 18 have a predetermined thickness and are formed of a material having a predetermined hardness to provide the desired flexibility. Axial forces in the distal or downward direction are applied to insert the bulb. The flanges 18 provide the necessary securement when cooperating with the bulb threading to prevent unintentional removal. Sufficient axial forces in the proximal or upward direction, in combination with the flexibility of the flanges 18, will enable quick removal of the bulb without damage the socket.

Figure 8:
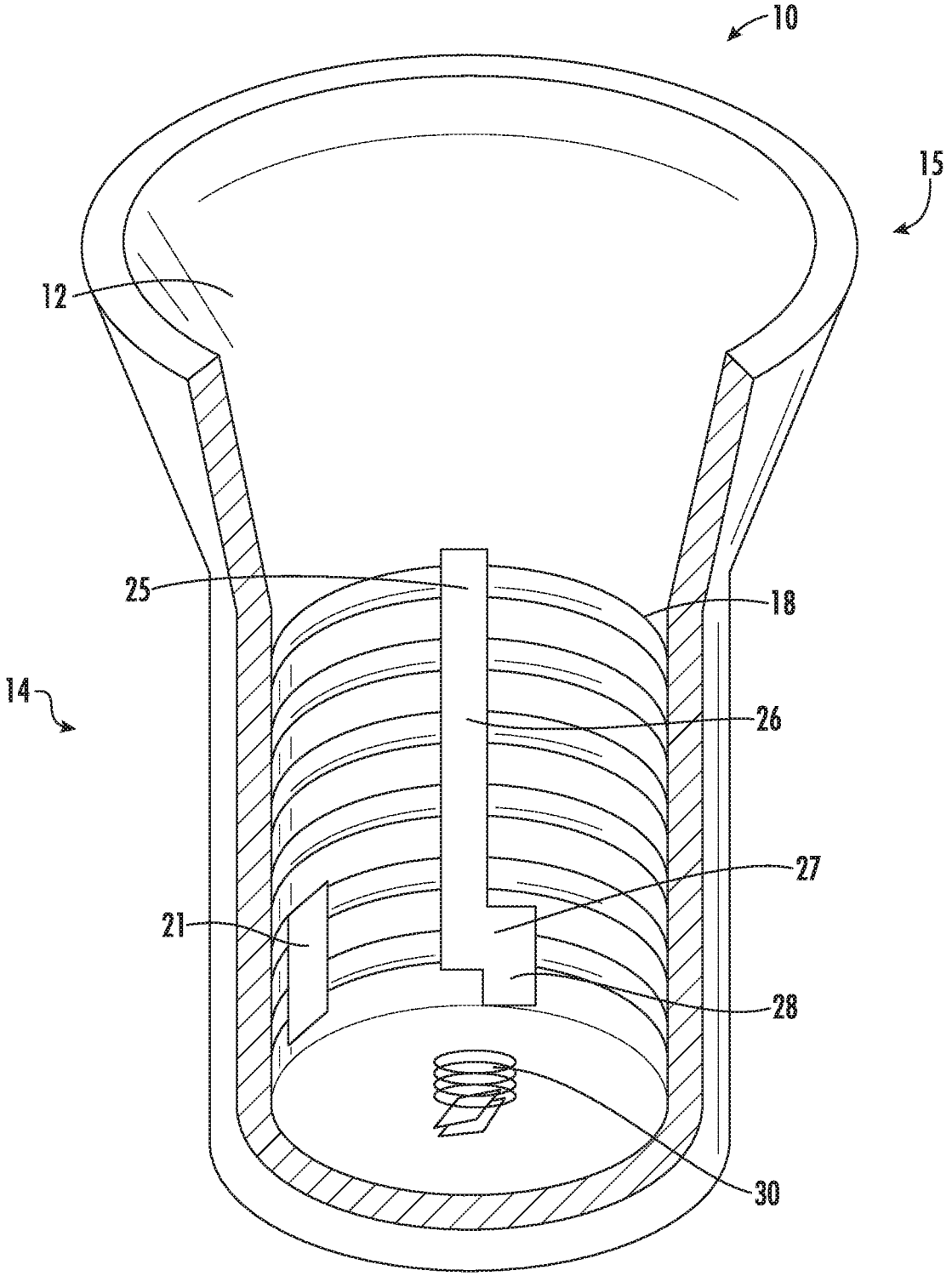
FIG. 8 is a front, cross-sectional view of the force-driven socket according to another aspect of the present invention.

FIG. 8 illustrates another aspect of the present invention when bayonet light bulbs are used in connection with the socket 10. The distal portion 14 of the cavity 12 defines a channel 25 which defines a longitudinal upper portion 26, a lateral medial portion 27 and a longitudinal lower portion 28. Accordingly, corresponding flanges of a bayonet bulb are applied with axial forces (downward) and the bulb flange traverses the length of the upper portion 26, the bulb is rotated by the use with lateral forces whereby the bulb flange traverses the lateral portion 27 and then continued axial force urges the bulb flange into the lower portion 28 of the channel 25. A spring 30 provides upward, proximal forces against the bottom of the bulb to urge the mating bulb flange upward within the lower portion 28 and is securely retained therein. The spring 30 is shown centered on the bottom of the channel 25, but may be positioned off-center as well. Flanges 18, according to any of the aforementioned aspects of the present invention, are defined by the interface assembly 16. Although a flange of a particular configuration is illustrated in FIG. 8, it is to be understood that flanges of any of the configurations disclosed herein may be utilized with the channel 25. The socket 10 according to this aspect may, therefore, be used with either a threaded or bayonet style bulb. Of course, if only a bayonet style bulb is to be used, the flanges 18 may not be present in the socket 10.

Figure 9D:
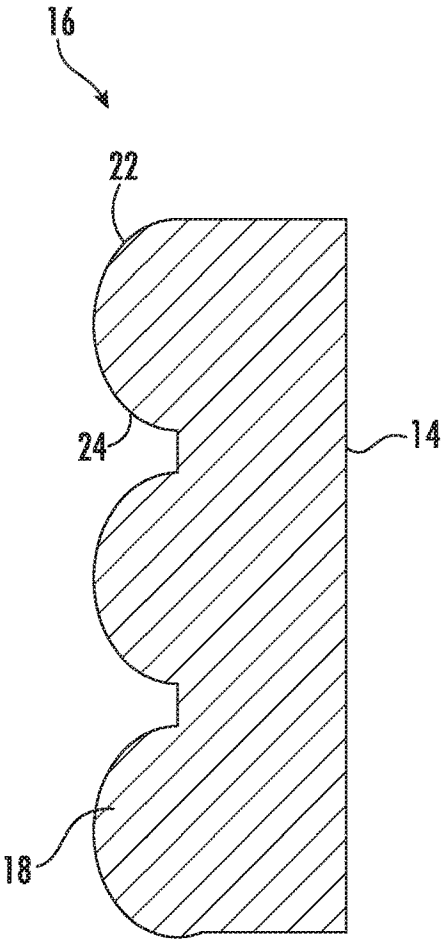
FIGS. 9A-9D are schematic illustrations of flange profiles.
Figure 9C:
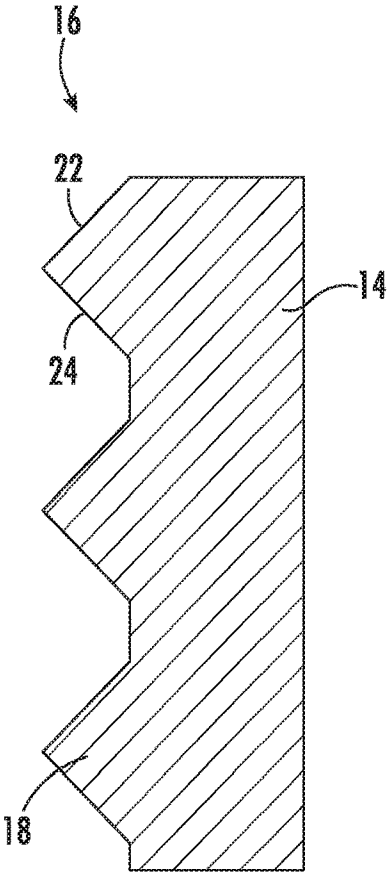
Figure 9B:
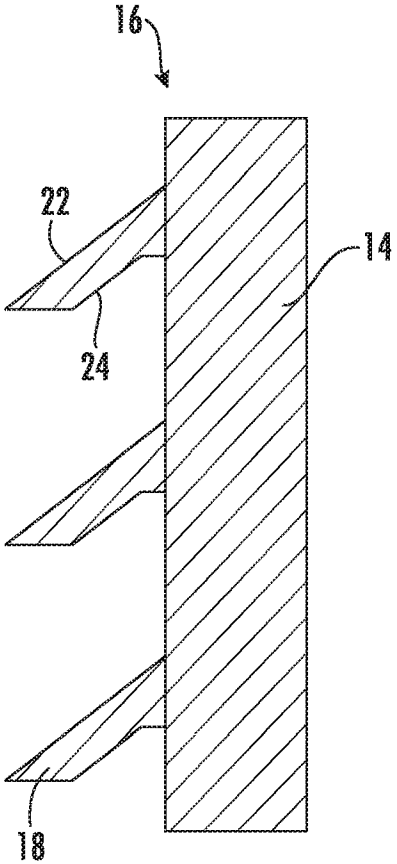
Figure 9A:
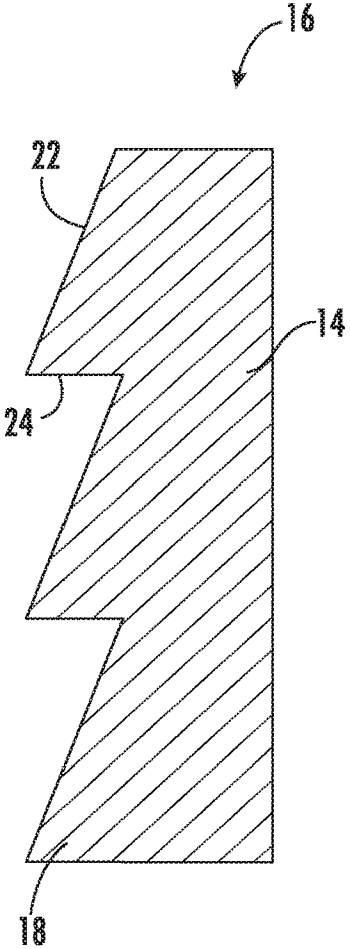

FIGS. 9A-9D are schematic representations of various flange 18 profiles which may be employed with the force-driven socket 10. According to these aspects, the bulb interface 16 includes flanges 18 having unique axial profiles. FIG. 9A represents angular flanges 18 with a downwardly sloping upper surface 22 and a generally horizontal bottom surface 24; FIG. 9B represents finger-like flanges with a generally downward sloping upper surface 22 and an angled bottom surface 24; FIG. 9C represents a triangular profile with an angled upper surface 22 and bottom surface 24; and FIG. 9C represents an arcuate flange 18 having curved upper 22 and bottom 24 surfaces.

Figure 10:
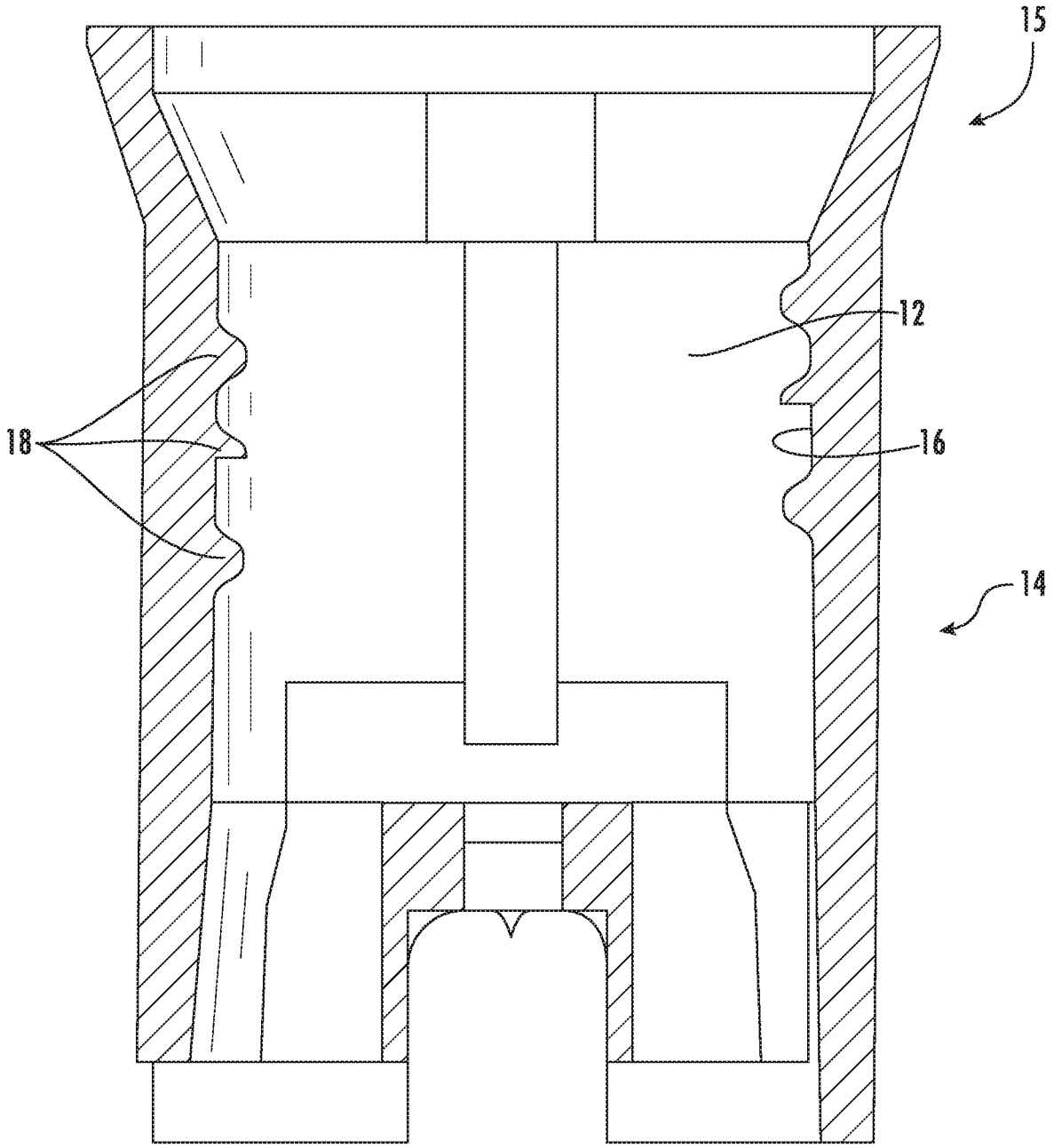
FIG. 10 is a cross-sectional view of one aspect of the force-driven socket.

FIG. 10 is a cross-sectional view of a force-driven socket 10 according to another aspect. The distal portion 14 includes a bulb interface 16 including a plurality of flanges 18. The flanges 18, as shown, include combinations of various configurations outlined above. For example, as shown the interface 16 includes a flange 18 according to FIGS. 9A and 9D. Any combination and any number of any of the aforementioned flange 18 profiles are within the spirit and scope of this disclosure. Moreover, any upper surface 22 may be used in combination with any bottom surface 24.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A light socket for operative receipt of a light bulb having a threaded distal end wherein the bulb may be selectively screwed into the socket and force driven by distal axial forces into the socket, said socketing comprising:

a proximal portion defining an open end configured for receipt of the light bulb, a distal bottom wall and a substantially cylindrical sidewall, said sidewall and said bottom wall defining a bulb receiving cavity and wherein said proximal portion is substantially continuous circumferentially around said proximal portion;

wherein said distal bottom wall comprises a contact for providing connectivity of the socket to a power source and said sidewall further comprises a neutral conductor on an inwardly facing surface thereof;

said sidewall inwardly facing surface defines a bulb interface comprising at least two flanges defining a threaded interface for cooperating with the threaded distal end of the light bulb, said at least two flanges being configured to and having tolerances for insertion of the light bulb by application of distal axial forces; and said sidewall inwardly facing surface below said proximal portion and further defines a bulb insertion channel having a first longitudinally extending channel having an inwardly facing opening, and said bulb interface inwardly facing surface further comprises a second perpendicularly extending channel extending transverse to said first channel, and said bulb insertion channel further comprises a third channel extending substantially longitudinally and extending distally from said second channel.

2. The light socket according to claim 1 further comprising a biasing member on said distal bottom wall for biasing the light bulb proximally.

3. The light socket according to claim 2 wherein said biasing member is a spring.

4. The light socket according to claim 1 wherein at least one of said at least two flanges includes a semi-circular cross-sectional profile.

5. The light socket according to claim 4 wherein two of said at least two flanges include said cross-sectional profile and are spaced apart a predetermined distance.

6. The light socketing according to claim 1 wherein said at least two flanges have a predetermined hardness so as to be flexible upon application of axial forces and being configured to and having tolerances for insertion of the light bulb by application of distal axial forces.

7. The light socket according to claim 1 wherein said at least one of said at least two flanges extending inwardly from said sidewall so as to define the bulb interface has a linear cross-sectional profile defined by a linear finger.

8. The light socketing according to claim 1 wherein said at least one of said at least two flanges extending inwardly from said sidewall so as to define the bulb interface is defined by a linear upper and bottom surface forming a triangular configuration in cross-section, said at least one of said at least two flanges configured to mate with a threaded bulb.

9. The light socket according to claim 8 wherein said at least two flanges include said triangle cross-sectional profile and are spaced apart a predetermined longitudinal distance.

10. A light socket for operative receipt of a light bulb having a threaded distal end wherein the bulb may be selectively screwed into the socket and force driven by distal axial forces into the socket, said socketing comprising:

a proximal open end configured for receipt of the light bulb, a distal bottom wall and a substantially cylindrical sidewall, said sidewall and said bottom wall defining a bulb receiving cavity;

wherein said distal bottom wall comprises a contact for providing connectivity of the socket to a power source and said sidewall further comprises a neutral conductor on an inwardly facing surface thereof;

said sidewall inwardly facing surface defines a bulb interface comprising at least two flanges defining a threaded interface for cooperating with the threaded distal end of the light bulb, said at least two flanges being configured to and having tolerances for insertion of the light bulb wherein at least one of said at least two flanges extending inwardly from said sidewall so as to define the bulb interface has a curvilinear cross-sectional profile defined by a curved upper surface and a substantially linear bottom surface.

11. The light socket according to claim 10 wherein two of said at least two flanges include said curvilinear cross-sectional profile and are spaced apart a predetermined distance.

12. A light socket for operative receipt of a light bulb having a threaded distal end wherein the bulb may be selectively screwed into the socket and force driven by distal axial forces into the socket, said socketing comprising:

a proximal open end configured for receipt of the light bulb, a distal bottom wall and a substantially cylindrical sidewall, said sidewall and said bottom wall defining a bulb receiving cavity;

wherein said distal bottom wall comprises a contact for providing connectivity of the socket to a power source and said sidewall further comprises a neutral conductor on an inwardly facing surface thereof;

said sidewall inwardly facing surface defines a bulb interface comprising at least two flanges, each extending substantially circumferentially around at least half of said inwardly facing surface and positioned longitudinally apart a predetermined distance so as to define a threaded interface for cooperating with the threaded distal end of the light bulb, said at least two flanges being configured to and having tolerances for insertion of the light bulb wherein said at least one of said at least two flanges extending inwardly from said sidewall so as to define the bulb interface has a cross-sectional profile defined by a linear finger having a length measured radially which is greater than its width measured longitudinally.

13. The light socket according to claim 12 wherein said linear finger extends radially inwardly and distally at an acute angle relative to the horizontal axis.

14. A light socket for operative receipt of a light bulb having a threaded distal end wherein the bulb may be selectively screwed into the socket and force driven by distal axial forces into the socket, said socketing comprising:

a proximal open end configured for receipt of the light bulb, a distal bottom wall and a substantially cylindrical sidewall, said sidewall and said bottom wall defining a bulb receiving cavity;

wherein said distal bottom wall comprises a contact for providing connectivity of the socket to a power source and said sidewall further comprises a neutral conductor on an inwardly facing surface thereof;

said sidewall inwardly facing surface defines a bulb interface comprising at least two flanges defining a threaded interface for cooperating with the threaded distal end of the light bulb, said at least two flanges being configured to and having tolerances for insertion of the light bulb wherein said at least one of said at least two flanges extending inwardly from said sidewall so as to define the bulb interface has a cross-sectional profile defined by a sloped upper surface extending distally from said inwardly facing surface at an acute angle to the horizontal axis and a bottom surface extending substantially perpendicular to said inwardly facing surface of said sidewall.

15. The light socket according to claim 14 wherein said at least two flanges have said cross-sectional profile and are spaced apart a predetermined distance.

16. A light socket for operative receipt of a light bulb having a threaded distal end wherein the bulb may be selectively screwed into the socket and force driven by distal axial forces into the socket, said socketing comprising:

a proximal portion defining an open end configured for receipt of the light bulb, a distal bottom wall and a substantially cylindrical sidewall, said sidewall and said bottom wall defining a bulb receiving cavity and wherein said proximal portion is substantially continuous circumferentially around said proximal portion;

wherein said distal bottom wall comprises a contact for providing connectivity of the socket to a power source and said sidewall further comprises a neutral conductor on an inwardly facing surface thereof;

said sidewall inwardly facing surface defines a bulb interface comprising at least two flanges defining a threaded interface for cooperating with the threaded distal end of the light bulb, said at least two flanges being configured to and having tolerances for insertion of the light bulb by application of distal axial forces wherein said at least two flanges have different cross-sectional profiles;

and said sidewall inwardly facing surface below said proximal portion and further defines a bulb insertion channel having a first longitudinally extending channel having an inwardly facing opening.

17. The light socketing according to claim 16 wherein said at least two flanges have a predetermined hardness so as to be flexible upon application of axial forces and being configured to and having tolerances for insertion of the light bulb by application of distal axial forces.

18. The light socket according to claim 16 wherein at least one of said at least two flanges includes a semi-circular cross-sectional profile.

19. The light socketing according to claim 16 wherein said at least one of said at least two flanges extending inwardly from said sidewall so as to define the bulb interface is defined by a linear upper and bottom surface forming a triangular configuration in cross-section, said at least one of said at least two flanges configured to mate with a threaded bulb.

20. A light socket for operative receipt of a light bulb having a threaded distal end wherein the bulb may be selectively screwed into the socket and force driven by distal axial forces into the socket, said socketing comprising:

a proximal portion defining an open end configured for receipt of the light bulb, a distal bottom wall and a substantially cylindrical sidewall, said sidewall and said bottom wall defining a bulb receiving cavity and wherein said proximal portion is substantially continuous circumferentially around said proximal portion;

wherein said distal bottom wall comprises a contact for providing connectivity of the socket to a power source and said sidewall further comprises a neutral conductor on an inwardly facing surface thereof; and said sidewall inwardly facing surface defines a bulb interface comprising at least two flanges defining a threaded interface for cooperating with the threaded distal end of the light bulb, said at least two flanges being configured to and having tolerances for insertion of the light bulb by application of distal axial forces wherein said at least two flanges have different cross-sectional profiles.

21. The light socketing according to claim 20 wherein said at least two flanges have a predetermined hardness so as to be flexible upon application of axial forces and being configured to and having tolerances for insertion of the light bulb by application of distal axial forces.

22. The light socket according to claim 20 wherein at least one of said at least two flanges includes a semi-circular cross-sectional profile.

23. The light socketing according to claim 20 wherein said at least one of said at least two flanges extending inwardly from said sidewall so as to define the bulb interface is defined by a linear upper and bottom surface forming a triangular configuration in cross-section, said at least one of said at least two flanges configured to mate with a threaded bulb.

* * * * *